US005621185A

United States Patent [19]

Spengler et al.

[11] Patent Number: 5,621,185

[45] Date of Patent: Apr. 15, 1997

[54] WARHEAD

[76] Inventors: Hans Spengler, Hochstr. 15, 8890 Aichach; Georg Schrödl, Sigmundstr. 13, 8899 Oberarnbach, both of Germany

[21] Appl. No.: 118,299

[22] Filed: Oct. 1, 1987

[30] Foreign Application Priority Data

Oct. 2, 1986 [DE] Germany ..... 36 33 535.5

[51] Int. Cl.[6] ..... F42B 12/18

[52] U.S. Cl. ..... 102/476; 102/308

[58] Field of Search ..... 102/306, 308, 102/310, 476, 211, 216, 262, 522

[56] References Cited

U.S. PATENT DOCUMENTS

| | | | |
|---|---|---|---|
| 4,291,627 | 9/1981 | Zeemba et al. | 102/211 |
| 4,430,943 | 2/1984 | Bock et al. | 102/522 |
| 4,620,483 | 11/1986 | Simpson | 102/222 |

FOREIGN PATENT DOCUMENTS

| | | | |
|---|---|---|---|
| 2310547 | 12/1976 | France | 102/476 |
| 2455802 | 1/1981 | France | 102/476 |
| 2829002 | 3/1984 | Germany . | |

*Primary Examiner*—Harold J. Tudor
*Attorney, Agent, or Firm*—McGlew and Tuttle

[57] ABSTRACT

The warhead comprises a preliminary shaped charge, a coaxial main shaped charge which is arranged at a distance from the latter, and an arrangement for increasing the axial distance between the preliminary shaped charge and the main shaped charge, which arrangement consists of a tube, in which the preliminary shaped charge is supported, a propelling charge, which is arranged behind the preliminary shaped charge, and a supporting device for the tube. The preliminary shaped charge is held in the tube by means of one or more shearing pins, wherein both the tube and the supporting device are provided in the ogive portion of the warhead with a cooperating catch device, so that the tube can be moved from the moved-in rest position into a moved-out working position after the ignition of the propelling charge for the preliminary shaped charge and can be caught in that position.

5 Claims, 2 Drawing Sheets

WARHEAD

Figure 1:
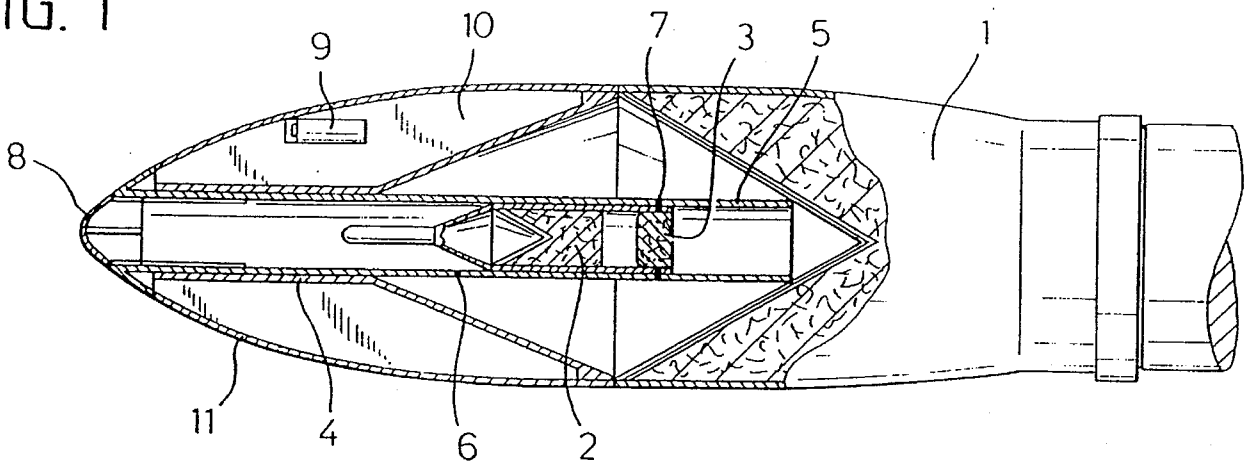

The present invention is directed to a warhead comprising a preliminary shaped charge, a coaxial main shaped charge arranged at a distance from the latter, and an arrangement for enlarging the axial distance between the preliminary shaped charge and the main shaped charge prior in time to a detonation triggering of the preliminary shaped charge, wherein this arrangement consists of a tube, in which the preliminary shaped charge is supported, a propelling charge arranged behind the preliminary shaped charge, and a supporting device for the tube in the portion of the warhead.

Such a double-charge warhead is used particularly for combatting active targets, such as active additional armoring, also known as active armoring.

This active armoring, e.g. of tanks, serves to destroy the developing jet of an impacting shaped charge in that the impacting munition initiates the explosive layer of the outer plate so that the plate is accelerated, carried into the jet path, and accordingly absorbs the jet force or destroys the developing jet so that no effective penetration depth is achieved in the main armoring of the tank to be protected.

One possibility of effectively combatting such active armoring consists in using double-charge warheads, wherein the first shaped charge activates the active armoring and the second shaped charge attacks the main armoring, which is now unprotected, after waiting for a period of time specifically related to the target, i.e. the time until the accelerated steel plates leave the projectile path and are initiated. Accordingly, because of the principle upon which its action is based, the second shaped charge must maintain a corresponding distance from the target, for which a non-contact optronic proximity sensor is generally necessary.

A warhead is known from FR-PS 23 10 547 which comprises a preliminary shaped charge which is arranged in a tubular antenna, the latter being arranged in the ogive portion of the warhead so as to be displaceable in the direction of flight. However, this preliminary shaped charge, which serves to combat active targets, comprises a rigid connection between the preliminary shaped charge and the main shaped charge even in the folded out state of the tubular antenna. Accordingly, the shock waves, swaths and splinters occurring when the preliminary shaped charge is detonated can have a considerable effect on the main shaped charge and can impair it. Moreover, the preliminary shaped charge is limited to small dimensioning and, accordingly, limited action because of the small distance between it and the main shaped charge.

A warhead is known from the present Applicant's DE-PS 28 29 002, which comprises at least one explosive preliminary acting body, particularly in the form of a shaped charge, a secondary acting body arranged at an axial distance relative to the latter, and comprises at least one device for enlarging the axial distance between the preliminary acting body and the secondary acting body, wherein a launcher or rocket propulsion unit serves as the device for increasing the axial distance. In this known warhead comprising one or more excentrically arranged launchers, the preliminary shaped charge is indeed ejected, but the launcher retains its original position.

It is the object of the present invention to improve such a warhead in such a way that the combustion chamber, which is available for the ejection of the preliminary shaped charge, is enlarged in order, in this manner, to further increase the action and/or the caliber of the preliminary shaped charge and to simultaneously considerably reduce the load of the main shaped charge and the interior of the ogive portion during the ejection of the preliminary shaped charge.

Proceeding from a warhead of the type mentioned in more detail in the beginning, it is suggested as a solution to this problem to hold the preliminary shaped charge in a tube by means of one or more shearing pins and to provide both the tube and the supporting device in the ogive portion of the warhead with a cooperating catch mechanism so that after the propelling charge for the preliminary shaped charge is ignited the tube is displaceable from its moved-in rest position into its moved-out working position and can be caught in this position.

A percussion fuse for the main shaped charge, which percussion fuse is displaceable in the longitudinal direction of the tube, is advantageously arranged at the move-out tube; The percussion fuse is inactive in the moved-in state of the tube and can be switched into the activated position by means of moving out.

A proximity sensor for the preliminary shaped charge is preferably provided in the front portion of the ogive portion and a central cover, which can be pushed off at the moment of the ignition of the propelling charge for the preliminary shaped charge, is provided at the tip of the ogive portion.

It is particularly favorable if the move-out tube is supported in a securely arranged guide tube and if at least one additional impact contact in the form of a shoulder contact for the main shaped charge is provided in the ogive portion.

Due to the fact that the preliminary shaped charge, which moves forward after the ignition of the propelling charge, carries the move-out tube along with it, the advantage is achieved that the distance of acceleration for the preliminary shaped charge is increased by the length of the tube, including the distance traveled until the tube catches in the supporting device, so that a considerably larger combustion chamber volume is achieved in conjunction with very short acceleration distances for the preliminary shaped charge.

In addition, the increase in the combustion chamber volume and the increased acceleration distances achieve the advantage that the pressures occurring during the expansion of the propelling charge gases are substantially reduced and the loading of the supporting device in the ogive portion and of the main shaped charge is substantially reduced, and, if a corresponding lining is provided, the jet forming, frustum-shaped surface of the main shaped charge is even kept free of impurities.

Because an impact contact is provided at the tip of the move-out tube for the main shaped charge, a distance is maintained from the target which is optimal for the main shaped charge, so that the latter can be deployed at optimal capacity against the remaining target.

The invention is explained in more detail in the following by means of the drawing which shows an advantageous embodiment example.

Figure 2:
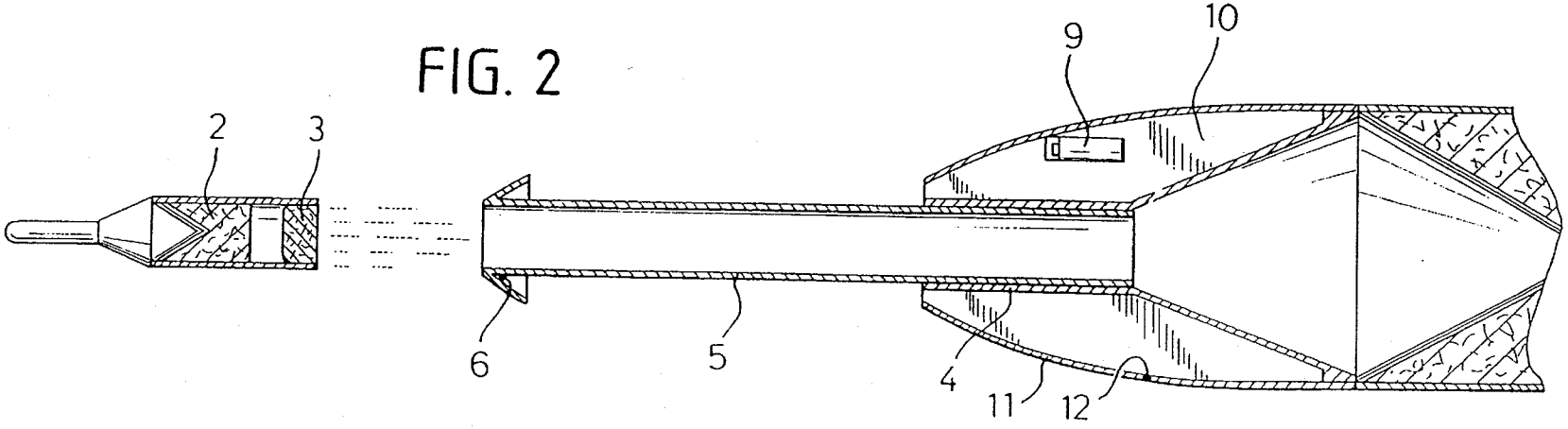
Figure 2A:
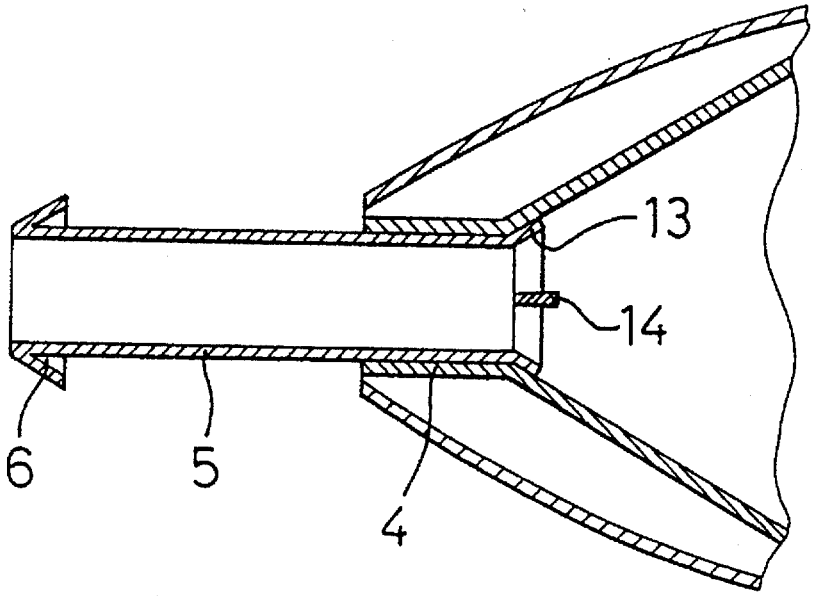

FIG. 1 shows a section in the longitudinal direction through a warhead, according to the invention, in the rest state, FIG. 2 shows a longitudinal section through this warhead after the detonation triggering of the preliminary shaped charge, and FIG. 2*a* is a partial axially extending sectional view of one embodiment of the warhead.

In the warhead shown in the drawings, a main shaped charge is designated in a schematic manner by 1 and is arranged in a conventional manner at the rear (as seen in the direction of flight) end of the warhead and comprises a jet forming, frustum-shaped covering, A supporting device 10, which is likewise frustum-shaped and is provided with a guide tube 4 at its crown portion so as to be concentric relative to the longitudinal axis of the warhead, adjoins this frustum-shaped covering, the guide tube 4 being open on both ends.

This supporting device 10 is arranged in the ogive portion 11 of the warhead and, in addition, comprises a sensor 9 for determining the distance of the warhead from the target to be attacked, as well as a central cover 8 at the tip of the ogive portion 11 for the aerodynamic stability of the warhead.

A tube 5, in which a preliminary shaped charge 2, including a propelling charge 3, is arranged close in front of the main shaped charge 1, is supported in the guide tube 4, which is securely connected with the supporting device 10. The preliminary shaped charge 2 is fastened at the tube 5 by means of shearing pins 7, the tube 5 being displaceable in the guide tube 4.

If a suitable distance for combatting an active target, not shown, is determined by means of the sensor 9, the propelling charge 3 is ignited by means of an igniting device so that the preliminary shaped charge 2 is accelerated forward and the tube 5 is carried along in the guide tube 4 for a certain distance (FIG. 2) in that the shearing pins 7, which connect the tube 5 with the preliminary shaped charge 2, are sheared off. After the moved-out position of the tube 5 in the guide tube 4 is achieved, the preliminary shaped charge, including the respective propelling charge, can freely exit the tube 5 so as to attack the active armoring. Both the supporting device 10 and the move-out tube 5 are provided with a suitable catching device so that the tube 5 catches in the supporting device 10 in the moved-out position. This catching device can consist, for example, of one or more stops, which are arranged in the rear end of the tube 5, or, as shown in FIG. 2*a*, of an annular flange 13, so that it can occupy the position shown in FIG. 2 after the tube moves out.

In addition to the flange 13, stops 14 are also provided at the rear end of the tube 5.

At the same time that the tube 5 moves out, an impact contact 6 for the main shaped charge 1 is moved out of the position shown in FIG. 1, in which it is inactive, into the position shown in FIG. 2 and is accordingly activated, so that the main shaped charge 1 is made to detonate when the warhead, which is freed by the preliminary shaped charge, impacts on the actual target to be attacked. In addition to this impact contact, which is arranged on the front end of the tube 5, shoulder contacts 12 can be provided in the ogive portion in addition.

Another possibility for triggering the main shaped charge 1 consists in obtaining the corresponding proximity information by means of a proximity sensor, wherein, however, it must be taken into account that the detonation of the ejected preliminary shaped charge 2 can effect a possible interference of the sensor for the main shaped charge.

Another possibility for the ignition of the main shaped charge consists in producing a suitable pulse during the ejection of the preliminary shaped charge and delaying this pulse, e.g. by means of pyrotechnical time delay elements or electrical time delay members, in order to ignite the main shaped charge at a determined time after the preliminary shaped charge is ejected. However, in so doing, all kinematic variables, such as the warhead velocity, the velocity of the preliminary shaped charge (behavior of the propellant at low/high temperatures), and the target distance inaccuracies of the proximity sensors, must be taken into account in the ignition distance.

With the warhead, according to the invention, comprising a preliminary shaped charge, which can be ejected, and a holding tube, which is mechanically movable, the entire volume in the funnel-shaped area and the main shaped charge and the supporting device can be used as combustion chamber volume, so that larger calibers are usable for the preliminary shaped charge and, at the same time, smaller loads act on the main shaped charge. In addition, an optimal target distance adjustment for the main shaped charge is achieved in that a mechanical impact contact is provided at the tip of the move-out tube, by means of which the main shaped charge is ignited during impact on the target.

We claim:

1. Warhead having a flight direction comprising a casing having a central axis extending in the flight direction, said casing being a first end leading in the flight direction and an opposite second end, a preliminary shaped charge located within said casing, a coaxial main shaped charge located in said casing spaced along the central axis between said preliminary shaped charge and the second end of said casing, means for increasing the axial spacing between said preliminary shaped charge and said main shaped charge prior to triggering detonation of said preliminary shaped charge, said spacing increasing means comprising an axially extending tube located within said casing and extending generally in parallel relative to the central axis, said tube having a first end closer to the first end of said casing and a second end closer to second end of said casing, a propelling charge for said preliminary shaped charge located within said tube between said preliminary shaped charge and the second end of said tube, said propelling charge is ignited by an igniting device for accelerating the preliminary shaped charge forward and out of the tube and for moving the tube out of the first end of said casing, said casing having an axially extending ogive portion extending from the first end of said casing toward the second end thereof, means within said ogive portion for supporting said tube, at least one shearing pin located within said tube for securing said preliminary shaped charge in spaced relation from the first end of said tube, said tube being displaceable from a moved-in rest position within said casing to a moved-out working position extending axially out of the first end of said casing, means on one of said tube and said means for supporting said tube for securing said tube in said means for supporting said tube in the moved-out position, and a sensor for said preliminary shaped charge located in said ogive part.

2. Warhead according to claim 1, wherein an impact contact (6) for the main shaped charge (1), is located within and is displaceable in the axial direction of the tube, said impact contact (6) is inactive in the moved-in position of the tube (5) and can be switched into an activated position when the tube (5) is in the moved-out position.

3. Warhead according to claim 1 or 2, wherein the ogive portion (11) has a tip at the first end of said casing comprising a central cover (8) displaceable therefrom at the moment of ignition of the propelling charge (3) for the preliminary shaped charge (2).

4. Warhead according to claim 1 or 2, wherein said tube (5) is supported so as to be displaceable in a guide tube (4) securely arranged coaxially relative to the central axis of the warhead casing.

5. Warhead according to claim 1 or 2, wherein at least one additional impact contact in the form of a shoulder contact (12) for the main shaped charge (1) is provided in the ogive portion (11).

* * * * *